US006851829B2

(12) United States Patent
Wu

(10) Patent No.: US 6,851,829 B2
(45) Date of Patent: Feb. 8, 2005

(54) LOCKING DEVICE FOR LOCKING A LAMP ROD

(76) Inventor: Wen-Chang Wu, 235 Chung-Ho Box 8-24, Taipei (TW)

( * ) Notice: Subject to any disclaimer, the term of this patent is extended or adjusted under 35 U.S.C. 154(b) by 129 days.

(21) Appl. No.: 10/400,993

(22) Filed: Mar. 25, 2003

(65) Prior Publication Data

US 2004/0190292 A1 Sep. 30, 2004

(51) Int. Cl.[7] ..... F21V 19/00; H01R 4/52

(52) U.S. Cl. ..... 362/217; 362/457; 439/242; 439/818

(58) Field of Search ..... 362/217, 221, 362/226, 288, 457; 439/242, 817, 818

(56) References Cited

U.S. PATENT DOCUMENTS 2,166,346 A * 7/1939 Douglas ..... 439/818
2,205,244 A * 6/1940 Douglas ..... 439/818
2,259,915 A * 10/1941 Weritz ..... 439/242
2,441,456 A * 5/1948 Thayer ..... 362/217
5,145,248 A * 9/1992 Chuan ..... 362/217
5,634,820 A * 6/1997 Vakil ..... 362/226
6,062,713 A * 5/2000 Renlger et al. ..... 362/226

* cited by examiner

*Primary Examiner*—Alan Cariaso

(57) ABSTRACT

The locking device serves for locking a lamp and a lamp rod. A wire winding box is coupled to the lamp seat. A portion of the lamp seat has a penetrating hole. The lamp seat is locked with an inserting seat. The lamp seat is protruded with a platform and a guide hole is formed on the platform. The connecting structure is formed by an embedding block and a spring. The lamp rod is exactly inserted into the end portion in the inserting seat of the lamp seat for electric conduction. A top of the lamp rod is installed with a plurality of recesses. At the time that the lamp rod is inserted, the inclined surface will push the embedding block to compress the spring so as to confined the lamp rod. Thereby, the user can assembly the lamp rod by inserting it to the lamp seat easily.

2 Claims, 4 Drawing Sheets

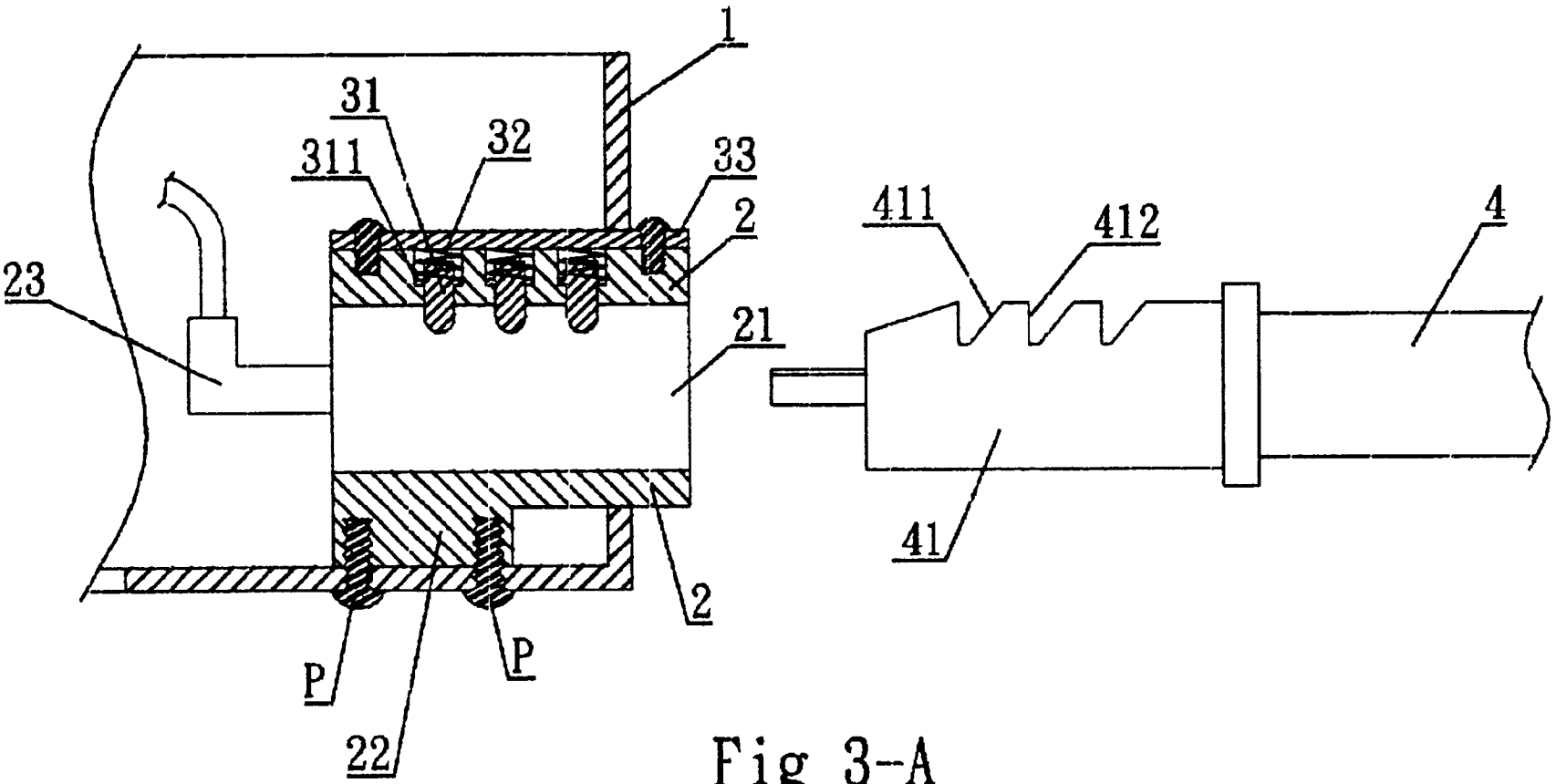
Fig 3-A

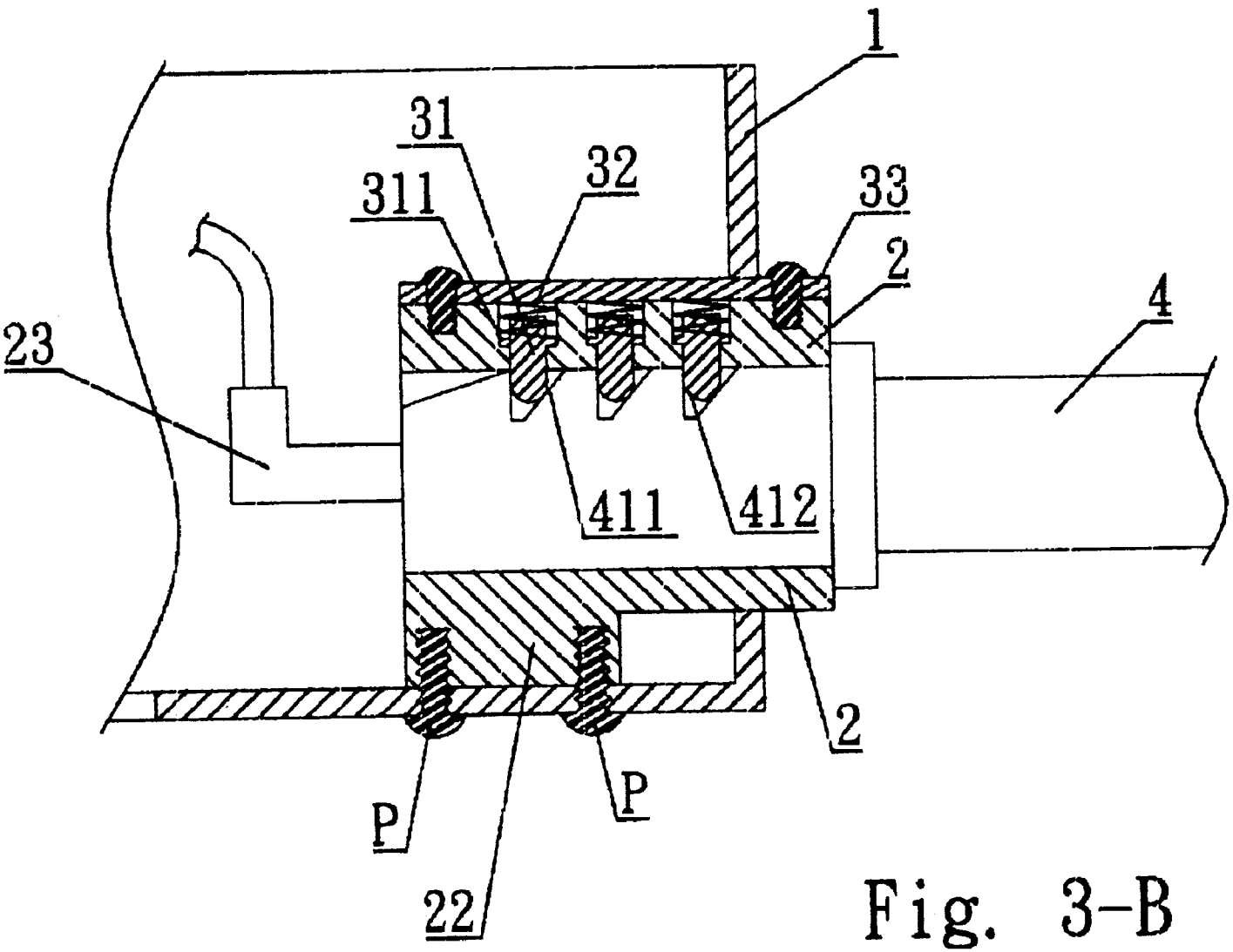
Fig. 3-B

LOCKING DEVICE FOR LOCKING A LAMP ROD

BACKGROUND OF THE INVENTION

The present invention relates to lamp assembly devices, and particularly to a locking device for locking a lamp rod. By the design of the present invention, a user can assembled the lamp rod by inserting it into the lamp seat easily. Thus, the lamp is detachable for storage and transfer with a smaller volume.

The prior art buckling structures of lamps, such as wall lamps, seat lamps, or stand lamps, are assembled by screwing studs with nuts. Not only the collision easy occurs, but also the locking tools (for example, spanners, openers, etc.) are necessary. In assembly, the wires will expose so as to generate electric shock. Moreover, the assembly work is tedious and thus it is unsuitable for being assembled by the users themselves. Thus generally, the wire winding box is assembled with the inserting rod before sale. Thereby, the cost is high and a larger space is necessary for transfer and storage.

SUMMARY OF THE INVENTION

Accordingly, the primary object of the present invention is to provide a locking device for locking a lamp and a lamp rod. A bottom of the wire winding box is coupled to the lamp seat has through hole. A portion of the lamp seat coupled to the wire winding box has a penetrating hole. A distal end of the lamp seat is locked with an inserting seat. A top of the lamp seat is protruded with a platform and a guide hole is formed on the platform for embedding the connecting structure. The connecting structure is formed by an embedding block in the guide hole of the lamp seat and a spring placed above the embedding block. A front end of the lamp rod is exactly inserted into the end portion in the inserting seat of the lamp seat for electric conduction. A top of the lamp rod is installed with a plurality of recesses. Each recess has an inclined surface and a vertical surface; thereby, at the time that the lamp rod is inserted, the inclined surface will push the embedding block to compress the spring so as to confine the lamp rod. Thereby, the user can assembly the lamp rod by inserting it to the lamp seat easily.

The various objects and advantages of the present invention will be more readily understood from the following detailed description when read in conjunction with the appended drawing.

BRIEF DESCRIPTION OF THE DRAWINGS

FIG. 3A is a plane cross section view showing the insertion of lamp rod of the present invention.

FIG. 3B is a plane cross section view showing a view after the lamp rod is inserted.

BRIEF DESCRIPTION OF THE PREFERRED EMBODIMENTS

Figure 1:
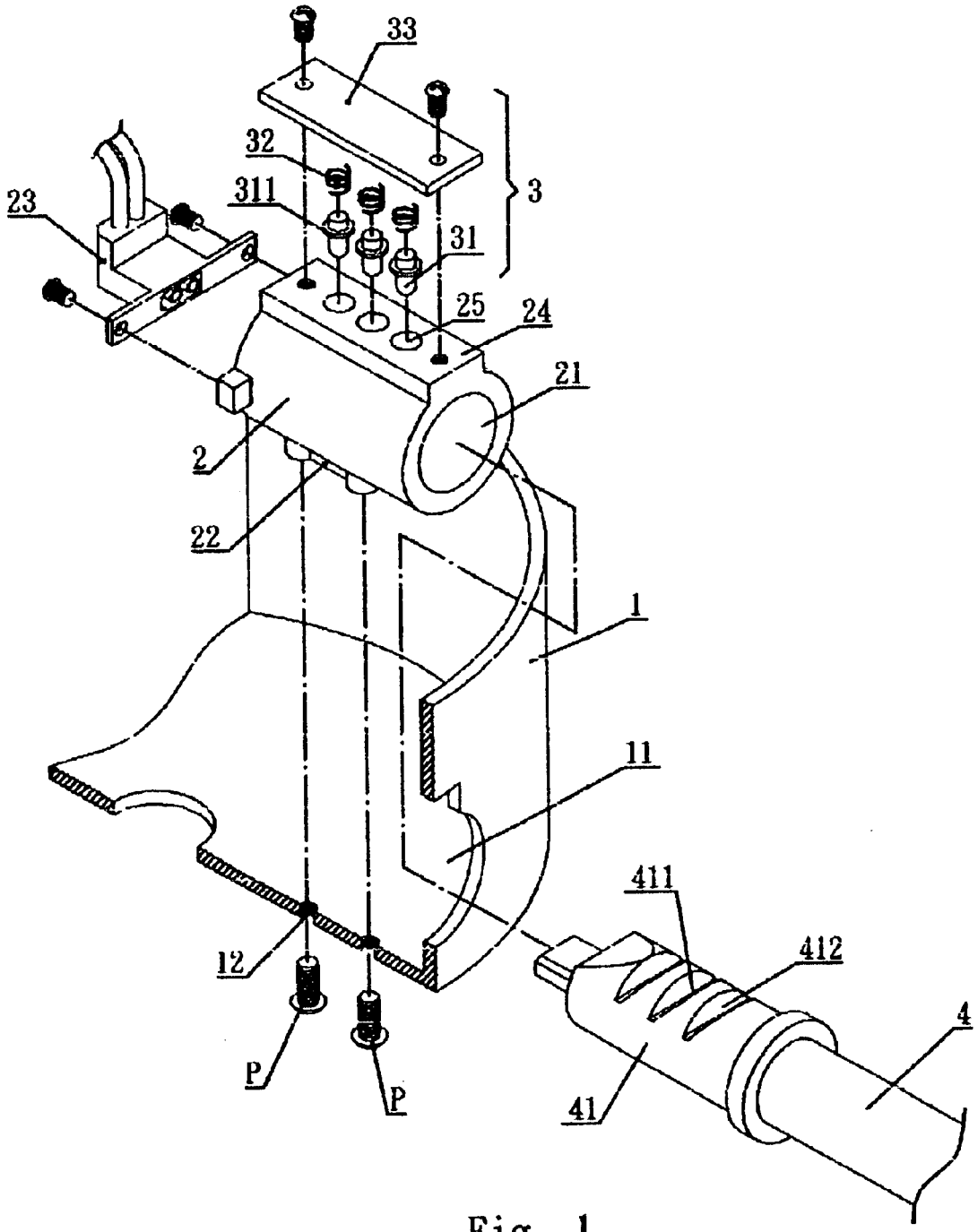
FIG. 1 is an exploded perspective view of the present invention.
Figure 2:
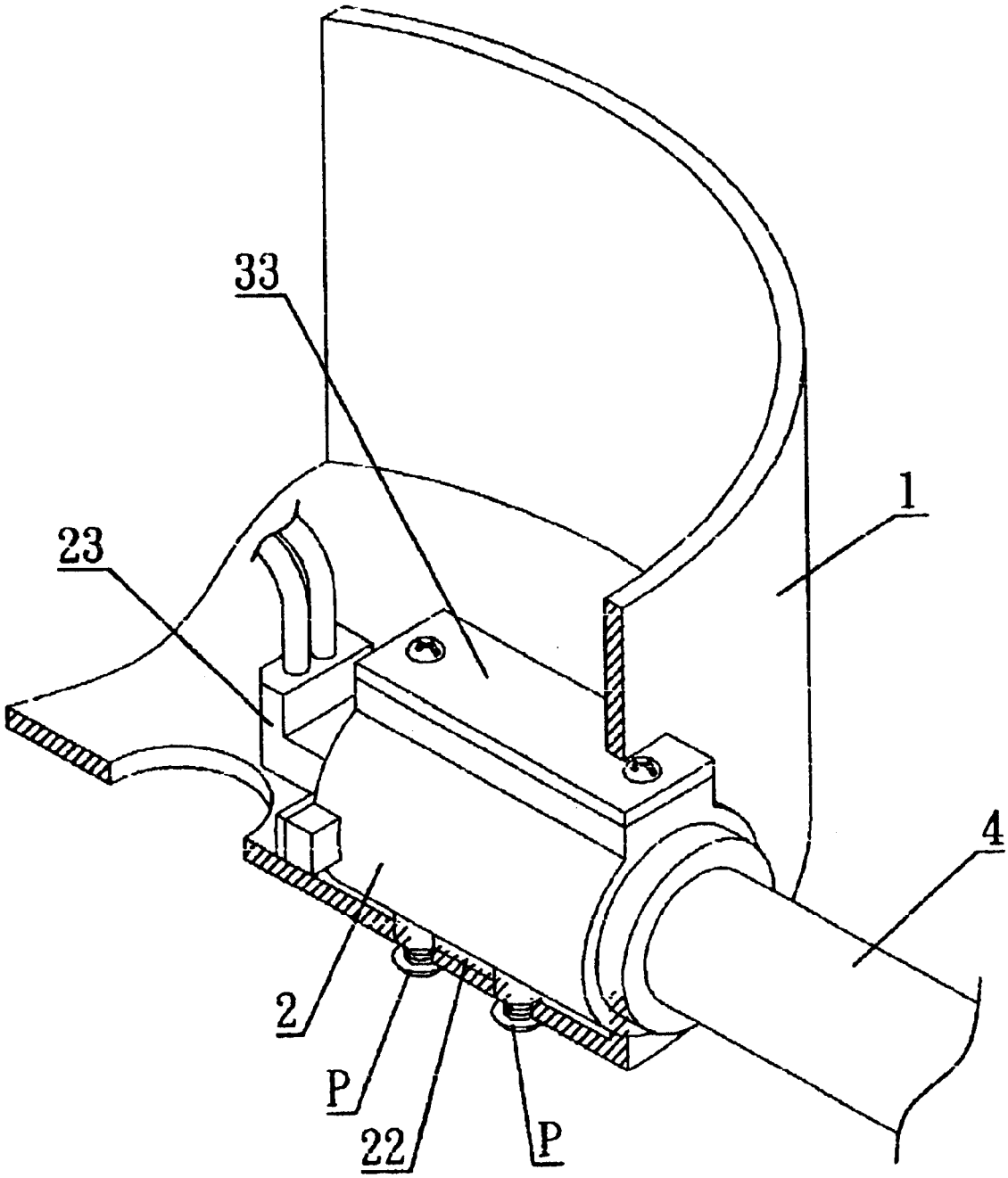
FIG. 2 is an assembled perspective view of the present invention.

Referring to FIGS. 1 and 2, the locking device for locking a lamp rod of the present invention is illustrated. The locking device includes a lamp seat 2 firmly secured to a lateral side of a wire winding box 1, a connecting structure 3 within the lamp seat 2 and a lamp rod 4 inserted into the lamp seat 2.

A lateral side of the wire winding box 1 has a via hole 11 and a bottom of the wire winding box 1 coupled to the lamp seat 2 has through hole 12 for being passed by a stud P so as to lock the lamp seat 2 to a predetermined positioned.

A portion of the lamp seat 2 coupled to the via hole 11 of the wire winding box 1 has a penetrating hole 21 and a bottom of the lamp seat 2 protruded with a locking seat 22 with a configuration corresponding to the through hole 12 of the wire winding box 1, thereby the stud P can pass through the through hole 12 from a lower end of the wire winding box 1 and then is locked to the locking seat 22 so as to fix the lamp seat 2 to the wire winding box 1. A distal end of the lamp seat 2 is locked with an inserting seat 23 which is exactly resisted by the end portion 41 of the lamp rod 4. In assembly, the inserting seat 23 is installed with electric wires and then it is placed in a mold for shaping so that the wire is firmly secured in the inserting seat 23. A top of the lamp seat 2 is protruded with a platform 24 and a guide hole 25 is formed on the platform 24 for embedding the connecting structure 3.

The connecting structure 3 is formed by an embedding block 31 in the guide hole 25 of the lamp seat 2 and a spring 32 placed above the embedding block 31. A press plate 33 locked to the platform 24 of the lamp seat 2 for confining the embedding block 31 and the spring 32 to a top of the lamp seat 2. An annular edge of the embedding block 31 is installed with a larger stepped edge 311 which exactly resists against a top of the platform 24 so that as a front end of the embedding block 31 is pushed by the spring 32, it will protrude from the guide hole 25, but not fall out from the guide hole 25 so that the lamp rod 4 can inserted thereinto.

A front end of the lamp rod 4 is exactly inserted into the end portion 41 in the inserting seat 23 of the lamp seat 2 for electric conduction. A top of the lamp rod 4 is installed with a plurality of recesses. Each recess has an inclined surface 411 and a vertical surface 412. Thereby, at the time that the lamp rod 4 is inserted, the inclined surface 411 will push the embedding block 31 to compress the spring 32 so as to confine the lamp rod 4.

Thereby, the user can assembly the lamp rod 4 by inserting it to the lamp seat 2 easily.

Referring to FIG. 3, a guide hole 24 is at a top of the lamp seat 2 and the lamp rod 4 is installed with recesses at position coupled to the connecting structure 3 of the lamp seat 2. When the lamp rod 4 inserts into the penetrating hole 21 of the lamp seat 2, the recess of the lamp rod 4 exactly resists against the side of the inclined surface 411 of the recess so as to push the embedding block 31 of the connecting structure 3 to move upwards. Thereby, the lamp rod 4 can be inserted easily (referring to FIG. 3A).

After the lamp rod 4 is inserted, the embedding block 31 of the connecting structure 3 is return by the restoring force of the spring. Thereby, the embedding block 31 resists against the recess of the lamp rod 4. By the vertical surface 412 of the recess to position the lamp rod 4 to the connecting structure 3, the lamp rod 4 will not retract out. Thus, the lamp rod 4 can be inserted into the lamp seat 2 so that the lamp seat 2 is conductive to the lamp rod 4.

By assembling the lamp seat 2 (for assembling the lamp rod 4) into the wire winding box 1 in advance, the user can insert the lamp rod 4 into the lamp seat 2 of the wire winding box 1 for use without using any studs.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A locking device for locking a lamp rod comprising a lamp seat firmly secured to a lateral side of a wire winding box, a connecting structure within the lamp seat and a lamp rod inserted into the lamp seat; wherein a lateral side of the wire winding box has a via hole and a bottom of the wire winding box coupled to the lamp seat has through hole;

a portion of the lamp seat coupled to the via hole of the wire winding box has a penetrating hole; a distal end of the lamp seat is locked with an inserting seat; a top of the lamp seat is protruded with a platform and a guide hole is formed on the platform for embedding the connecting structure;

the connecting structure is formed by an embedding block in the guide hole of the lamp seat and a spring placed above the embedding block; a press plate locked to the platform of the lamp seat for confining the embedding block and the spring to a top of the lamp seat; an annular edge of the embedding block is installed with a larger stepped edge which exactly resists against a top of the platform so that as a front end of the embedding block is pushed by the spring, it will protrude from the guide hole, but not fall out from the guide hole; and a front end of the lamp rod is exactly inserted into the end portion in the inserting seat of the lamp seat for electric conduction; a top of the lamp rod is installed with a plurality of recesses; each recess has an inclined surface and a vertical surface; thereby, at the time that the lamp rod is inserted, the inclined surface will push the embedding block to compress the spring so as to confined the lamp rod;

thereby, a user can assembled the lamp rod by inserting it to the lamp seat easily.

2. The locking device for a lamp rod as claimed in claim 1, wherein a bottom of the lamp seat protruded with a locking seat with a configuration corresponding to the through hole of the wire winding box; thereby a stud passes through the through hole from a lower end of the wire winding box and then is locked to the locking seat so as to fix the lamp seat to the wire winding box.

* * * * *